United States Patent [19]

Garcia

[11] Patent Number: 4,459,202

[45] Date of Patent: Jul. 10, 1984

[54] RECOVERY OF BITUMINOUS PRODUCTS FROM TAR SANDS

[75] Inventor: Sylverio M. Garcia, Norman, Okla.

[73] Assignee: Capetrol International, Inc., Norman, Okla.

[21] Appl. No.: 549,151

[22] Filed: Nov. 7, 1983

Related U.S. Application Data

[63] Continuation-in-part of Ser. No. 493,968, May 12, 1983, abandoned.

[51] Int. Cl.[3] ..... C10G 1/04

[52] U.S. Cl. ..... 208/11 LE; 208/8 LE; 252/364

[58] Field of Search ..... 252/364; 208/11 LE, 208/8 LE

[56] References Cited

U.S. PATENT DOCUMENTS

| | | | |
|---|---|---|---|
| 3,581,823 | 1/1971 | Feuerbacher | 208/11 LE |
| 4,132,639 | 1/1979 | Kantz et al. | 208/11 LE |
| 4,156,463 | 5/1979 | Hall | 208/11 LE |
| 4,357,230 | 11/1982 | Sibley et al. | 208/11 LE |

*Primary Examiner*—Delbert E. Gantz
*Assistant Examiner*—A. Pal
*Attorney, Agent, or Firm*—Glen M. Burdick

[57] ABSTRACT

Acidic solvent compositions and method for separating bituminous products from tar sands which do not require a high shear environment employing such acidic solvent compositions are disclosed. The acidic solvent compositions comprise from about 15 to about 30 volume percent of an aqueous amine modified acidic constituent having a pH value of less than about 1, from about 1 to about 20 volume percent hydrofluoric acid, from about 5 to about 20 volume percent of a friction reducing compound, and from about 40 to about 80 volume percent of a hydrocarbon solvent. The aqueous amine modified acidic constituent of the acidic solvent compositions is prepared by (a) mixing from about 45 to about 80 weight percent hydrochloric acid with from about 20 to about 55 weight percent phosphoric acid to produce a substantially homogeneous acidic mixture; (b) mixing the acidic mixture with an effective amount of water to provide an aqueous acidic mixture; (c) admixing from about 2 to about 20 weight percent of a hydroxy carboxylic acid and from about 0 to about 20 weight percent of a dicarboxylic acid into the aqueous acidic mixture to produce a hydroxy carboxylic acid containing aqueous acidic mixture; and (d) admixing a minor effective amount of a polyamine with the hydroxy carboxylic acid containing aqueous acidic mixture.

39 Claims, No Drawings

RECOVERY OF BITUMINOUS PRODUCTS FROM TAR SANDS

CROSS REFERENCE TO RELATED APPLICATION

This application is a continuation-in-part application of copending patent application Ser. No. 493,968, entitled "Recovery of Bituminus Products From Tar Sands", filed May 12, 1983, now abandoned.

BACKGROUND OF THE INVENTION

1. Field of the Invention

The present invention relates to the recovery of bituminous products from tar sands, and more particularly, but not by way of limitation, to improved compositions for separating bituminous products from sand particles. In one aspect the present invention relates to improved acidic solvent compositions for use in the recovery of bituminous products from tar sands, and to a method for recovering such bituminous products.

2. Discussion of Prior Art

Tar sands are naturally occurring deposits which are generally constituted of bulk inorganic particles, such as siliceous sands, that are impregnated with a matrix of heavy petroleum or bitumen containing various types of hydrocarbons. Historically, the term "tar sand" has been applied to these deposits because of their similarity in appearance to asphaltic compositions, although they have also been described as oil sands and bituminous sands.

Tar sand deposits are found in significantly large reserves, such as the Athabasca tar sand deposits located near Ft. McMarray, Canada. Tar sand deposits are also found near Vernal, Green River and Sunnyside, Utah. These tar sand deposits contain significant reserves of potentially recoverable bituminous products. For example, it has been estimated that on the average one cubic yard of tar sands contains one barrel of bituminous product.

Various processes have heretofore been proposed for separating the bituminous products from tar sands by treatment with water, water/surfactant mixtures, solvents, heat, and combinations of the above. Generally, the prior art processes for separating bituminous materials from tar sands requires some form of crushing, grinding or otherwise mechanically comminuting the agglomerated tar sands to a finely divided state in order to obtain a more thorough exposure of the bituminous matrix material to the action of the recovery technique.

Grinding or crushing of the masses of tar sand is difficult and expensive because of the excessive equipment wear caused by the siliceous material which has a hardness greater than most components of the tar sand handling equipment. This is particularly important where the process requires that the tar sands be comminuted to relatively finely divided particles in order to increase exposure of the bituminous matrix to the recovery process.

A typical prior art process for the separation and recovery of bituminous products from tar sand is disclosed in U.S. Pat. No. 4,096,057 entitled "Apparatus and Method for Recovery of Bituminous Products from Tar Sands". The patent discloses a high shear environment in a liquid phase which causes the masses of tar sand to be rapidly reduced by attrition to sand particles and also rapidly strips the bituminous product from the finely divided detritus and sand resulting from this abradent action.

Solvents for the bituminous product in the method and apparatus of the beforementioned U.S. Pat. No. 4,096,057 include kerosene, gasoline, water/surfactant mixtures and mixtures of such liquids. Further, elevated temperatures in the liquid phase are employed to accelerate the attrition and stripping action by the liquid; and the liquid phase has a sufficient density to impart momentum to tar sand masses and provides a high shear environment.

In recent years a substantial effort has been made by the petroleum industry to develop new and improved solvent compositions and methods for the economical recovery of bituminous products from tar sands. It would be an advance in the art if a method for recovering the bituminous products from tar sands could be achieved using a solvent composition which did not require a high shear environment.

SUMMARY OF THE INVENTION

The present invention provides improved acidic solvent compositions for separating bituminous products from tar sands which do not require a high shear environment. Broadly, the improved acidic solvent compositions comprise from about 15 to about 30 volume percent of an aqueous amine modified constituent having a pH value of less than about 1, from about 1 to about 20 volume percent of a friction reducing compound, and from about 40 to about 80 volume percent of a liquid hydrocarbon solvent.

The aqueous amine modified constituent of the acidic solvent compositions of the present invention are desirably prepared by the steps of:

(a) mixing from about 45 to about 80 weight percent hydrochloric acid with from about 20 to about 55 weight percent phosphoric acid to produce a substantially homogeneous acidic mixture;

(b) admixing the acidic mixture with an effective amount of water to provide an aqueous acidic mixture;

(c) admixing from about 2 to about 20 weight percent of a hydroxy carboxylic acid and from about 0 to about 20 weight percent of a dicarboxylic acid into the aqueous acidic mixture to produce a hydroxy carboxylic acid containing aqueous acidic mixture; and (d) admixing a minor effective amount of a polyamine with the hydroxy carboxylic acid containing aqueous acidic mixture to provide the amine modified aqueous acidic composition.

In one aspect, the present invention provides a method for recovering bituminous products from tar sands employing the acidic solvent compositions of the present invention. Broadly, the method for recovering bituminous products from tar sands comprises introducing an effective amount of the acidic solvent composition into a vessel; agitating the acidic solvent composition; introducing chunks of tar sand into the acidic solvent composition while maintaining agitation thereon; and, recovering separated bituminous products from the residual sand particles.

An object of the present invention is to provide improved solvent compositions for use in the recovery of bituminous products from tar sands.

Another object of the present invention, while achieving the above stated object, is to provide an improved method for separating bituminous products from sand particles that does not require a high shear environment.

Another object of the present invention, while achieving the above stated objects, is to provide an economical method for recovering bituminous products from tar sands which does not suffer from the disadvantages of prior art processes.

Other objects, advantages and features of the present invention will become apparent from the following detailed description when read in conjunction with the appended claims.

DESCRIPTION OF PREFERRED EMBODIMENTS

The present invention provides improved acidic solvent compositions and methods for recovering bituminous products from tar sands. The acidic solvent compositions employed in the recovery of bituminous products from tar sands comprise from about 15 to about 30 volume percent of an aqueous amine modified acidic constituent having a pH value of less than about 1, from about 1 to about 20 volume percent hydrofluoric acid, from about 5 to about 20 volume percent of a friction reducing compound, and from about 40 to about 80 volume percent of a liquid hydrocarbon solvent. The acidic solvent compositions of the present invention, when employed in the recovery of bituminous products from tar sands, possess unique properties. For example, at least two of the constituents of the acidic solvent compositions have strong acidic properties (i.e. the aqueous amine modified constituent has a pH value of less than about 1, and the hydrofluoric acid), and yet the aqueous amine modified constituent and the hydrofluoric acid remain substantially inert and inactive until contacted with the tar sands.

The exact structure and function of the aqueous amine modified acidic constituent of the acidic solvent compositions and its ability to render the hydrofluoric acid substantially inert and inactive until the acid solvent compositions are contacted with tar sands is not known. However, one theory is that during the formulation of the aqueous amine modified acidic compositions a high concentration of hydrogen ions (H+) are released into and remain present in the aqueous amine modified acidic compositions. Thereafter, when the aqueous amine modified acidic compositions are mixed with hydrofluoric acid, the friction reducing compound and the liquid hydrocarbon solvent in the formulation of the acidic solvent compositions, the high concentration of hydrogen ions in the aqueous amine modified acidic compositions prohibit the release of hydrogen ions from the hydrofluoric acid and thus the acidic solvent compositions. Because the acid molecules cannot release their hydrogen ions (i.e. the amine modified acidic composition and the hydrofluoric acid), the acidic solvent compositions remain substantially inert and inactive until contacted with the tar sands (i.e. an active surface that can accept large quantities of hydrogen atoms). Upon contact with the tar sands the acid molecules present in the acidic solvent composition become active as long as the acidic solvent composition remains in contact with the active surface, and as long as the surface contains substances to exchange with the hydrogen ions of the acidic constituents of the acidic solvent composition. When the surface has been cleaved of its active substances the surface becomes passivated so that the exchange of the hydrogen ions discontinues and the aqueous amine modified acidic composition and the hydrofluoric acid of the acidic solvent composition become substantially inactive and inert.

The term "pH value" is generally employed as a means for expressing the degree of acidity or basicity of a solution. For example, at normal temperature a neutral solution, such as pure distilled water, has a pH of about 7; whereas a 1/10th normal solution of hydrochloric acid (approximately 3.65 grams hydrochloric acid per liter of water) has a pH near 1 and is considered to be strongly acidic. Thus, the aqueous amine modified acidic compositions having pH values of less than about 1 employed in the formulation of the acidic solvent compositions of the present invention would be considered strongly acidic, and would be difficult to handle except for their unique properties.

As previously stated, the structure of the aqueous amine modified acidic constituents of the acidic solvent compositions employed in the removal and recovery of bituminous products from tar sand is not known. Thus, the structure of the solvent compositions employed as the solubilizing agent for the bituminous material of tar sands, and the function of aqueous amine modified acidic constituents on hydrofluoric acid is also not known. However, the aqueous amine modified acidic compositions employed in the acidic solvent compositions of the present invention are prepared by a series of process steps wherein the ingredients are believed critical. The steps of addition of the ingredients employed to form the aqueous amine modified acidic compositions are not believed critical. However, especially desirable results have been obtained when the aqueous amine modified acid compositions are prepared by the following described process.

The initial step in preparing the aqueous amine modified acidic compositions for use as a constituent of the acidic solvent compositions of the present invention comprises admixing from about 45 to about 85 weight percent hydrochloric acid and from about 20 to about 55 weight percent phosphoric acid in a vessel for an effective period of time to provide a substantially homogeneous acidic mixture. Because strong fumes are emitted upon mixing the hydrochloric acid and the phosphoric acid, care should be exercised in the mixing of the two components to ensure that the mixing step is carried out in a well ventilated area or hood.

The time required to mix the hydrochloric acid and the phosphoric acid so as to provide a substantially homogeneous acidic mixture can vary widely; and the mixing time or period will generally depend upon the rate of addition of the two components, the amount of the two components, the rate of speed of agitation and the like.

All mixing and storage containers employed in the production of the aqueous amine modified acidic compositions are desirably fabricated of a substance that is acid resistant, such as stainless steel, plastic, fiberglass, glass and the like. It is desirable also that all containers used in the preparation of the aqueous amine modified acidic compositions be provided with covers for safety reasons and to keep foreign materials out of the product, especially the container in which the hydrochloric acid and phosphoric acid are mixed.

The homogeneous acidic mixture formed from the hydrochloric acid and the phosphoric acid is then admixed with an effective amount of water to provide an aqueous acidic mixture. The amount of water employed in the formation of the aqueous acidic mixture can vary widely, but is generally an amount sufficient to provide from about 70 to about 90 weight percent water in the aqueous acidic mixture. The aqueous acidic mixture is thoroughly stirred to ensure substantially complete dispersion of the homogeneous acid mixture of the hydrochloric acid and the phosphoric acid into the water, and to provide a substantially uniform aqueous acidic mixture.

While maintaining agitation on the aqueous acidic mixture, from about 2 to about 20 weight percent of a hydroxy carboxylic acid and from 0 to about 20 weight percent of a dicarboxylic acid are admixed with the aqueous acidic mixture to produce an aqueous acidic composition having a pH value of less than about 1. The hydroxy carboxylic acid is a critical ingredient in the formation of the aqueous acidic compositions; whereas the dicarboxylic acid is an optional ingredient. However, desirable results have been obtained when producing an aqueous acidic composition containing the dicarboxylic acid.

The amount of hydroxy carboxylic acid and dicarboxylic acid incorporated into the aqueous acidic mixture of the hydrochloric acid and phosphoric acid can vary widely within the ranges set forth hereinbefore. However, the optimum amounts of the hydroxy carboxylic acid and the dicarboxylic acid admixed with the aqueous acidic mixture are the amounts required to provide the aqueous acidic composition with from about 2 to about 10 weight percent hydroxy carboxylic acid and from about 1 to about 10 weight percent dicarboxylic acid.

When incorporating the dicarboxylic acid into the aqueous acidic mixture the dicarboxylic acid is admixed into the aqueous acidic mixture along with the hydroxy carboxylic acid. The order of addition of the dicarboxylic acid and the hydroxy carboxylic acid is not critical, although desirable results have been obtained when the dicarboxylic acid is introduced into the aqueous acidic mixture after the addition of the hydroxy carboxylic acid.

Any suitable hydroxy carboxylic acid can be employed in the preparation of the aqueous amine modified acidic compositions used in the practice of the present invention. Typical of such hydroxy carboxylic acids are citric acid, tartaric acid, malic acid and the like. However, especially desirable results have been obtained when the hydroxy carboxylic acid is citric acid.

Any suitable dicarboxylic acid can be employed in the preparation of the aqueous amine modified acidic compositions used in the practice of the present invention. Typical of such dicarboxylic acids are oxalic acid, malonic acid, succinic acid, glutaric acid, adipic acid and the like. However, when employing a dicarboxylic acid in the preparation of the aqueous amine modified acidic compositions., desirable results have been obtained when the dicarboxylic acid is oxalic acid.

The aqueous acidic compositions so produced will desirably contain from about 70 to about 90 weight percent water, and more desirably from about 75 to 80 percent water. Thus, depending upon the amount of the hydroxy carboxylic acid and dicarboxylic acid added to the aqueous acidic mixture (as well as the amount of water initially added to the acidic mixture formed by the hydrochloric acid and the phosphoric acid) it may be desirable to further dilute the aqueous acidic composition with an effective amount of water to insure that the concentration of water in the aqueous acidic composition is from about 70 to about 90 weight percent, more desirably from about 75 to 80 weight percent. In those instances where it is determined that the amount of water present in the aqueous acidic composition is less than the specified amount, the aqueous acidic composition is admixed with an effective amount of water so as to provide the aqueous acidic composition with the amount of water specified above.

The aqueous acidic compositions prepared by the process described above are substantially colorless liquids having an appearance substantially similar to water. The aqueous acidic compositions, which contain from about 70 to about 90 percent water and have pH values of less than about 1 (i.e. 0.49), are thereafter mixed with a minor effective amount of a polyamine to produce the amine modified aqueous acidic compositions having pH values of less than about 1 (i.e. 0.91). The minor effective amount of the polyamine incorporated into the aqueous acidic compositions can vary widely, but will generally range from about 1 to about 5 weight percent. Any suitable polyamine compatible with the aqueous acidic composition can be employed. Typical of such polyamines are hexamethylenetetramine, hexamethylenediamine, hexamethyleneimine, and the like. Desirable results have been obtained wherein the polyamine is hexamethylenetetramine; and the hexamethylenetetramine is incorporated into the aqueous acidic compositions in an amount of from about 2 to about 3 weight percent.

As previously stated, the water content of the aqueous acidic compositions is generally from about 70 to about 90 weight percent, and desirably from about 75 to about 80 weight percent. Thus, upon modification of the aqueous acidic compositions with the polyamine to produce the aqueous amine modified acidic compositions, it may be desirable to further dilute the aqueous acidic compositions with an effective amount of water such that upon addition of the polyamine the amine modified aqueous acidic compositions contain from about 70 to about 90 weight percent water, more desirably from about 75 to about 80 weight percent water.

The order of addition of the acid constituents (i.e. the aqueous amine modified acidic compositions and the hydrofluoric acid), the friction reducing compound and the liquid hydrocarbon solvent in the formulation of the acidic solvent compositions of the present invention is not critical; provided the acidic solvent compositions contain the specified amount of each of the ingredients, namely from about 15 to about 30 volume percent of the aqueous amine modified acidic composition, from about 1 to about 20 volume percent hydrofluoric acid, from about 4 to about 20 volume percent of the friction reducing compound, and from about 30 to about 80 volume percent of the liquid hydrocarbon solvent.

One suitable method for preparing the acidic solvent compositions employed in the removal of bituminous products from tar sand comprises admixing a predetermined amount of hydrofluoric acid with a predetermined amount of the aqueous amine modified acidic composition to produce a resulting acidic mixture. The predetermined amounts of the hydrofluoric acid and aqueous amine modified composition employed can vary widely but will be amounts sufficient to provide from about 15 to about 30 volume percent (more desirably about 20 volume percent) of the aqueous amine modified acidic composition in the acidic solvent composition, and from about 1 to about 20 volume percent (more desirably about 10 volume percent) of the hydrofluoric acid in the acidic solvent composition.

After the resulting acidic mixture has been formed a predetermined amount of a friction reducing compound is admixed into the resulting acidic mixture. The predetermined amount of the friction reducing compound can vary widely but will be in an amount sufficient to provide from about 4 to about 20 volume percent (more desirably about 10 volume percent) of the friction reducing compound in the acidic solvent composition.

The friction reducing compound is believed to have a dual function in the acidic solvent composition, namely, the friction reducing compound functions as a friction reducing agent and as an additional solvent for the recovered bituminous materials. Any suitable friction reducing compound soluble in the liquid hydrocarbon solvent can be employed in the preparation of the acidic solvent compositions of the present invention. However, it is desirable that the friction reducing compound be selected from a class of compounds which do not substantially alter the viscosity of the resulting acidic mixture when the components are subjected to agitation and form a dispersion or emulsion. Examples of compounds which meet the above criteria for the friction reducing compound are liquid organic acids, such as acetic acid, lauric acid, oleic acid and the like. However, especially desirable results have been obtained when the friction reducing agent is oleic acid.

The final step in the preparation of the acidic solvent compositions employed in the removal of bituminous materials from the tar sands is the blending of a predetermined amount of a hydrocarbon solvent into the two liquid phase mixture of the acidic mixture and the friction reducing compound. The predetermined amount of the hydrocarbon solvent can vary widely, but will be in an amount sufficient to provide from about 30 to about 80 volume percent (more desirably about 60 volume percent) of the hydrocarbon solvent in the acidic solvent composition. Because the acidic portion of the solvent composition (i.e. the aqueous amine modified constituent and the hydrofluoric acid) is not miscible with either the friction reducing compound or the hydrocarbon solvent, a two phase mixture forms when the acidic solvent composition is left standing in an unagitated state. Thus, the acidic solvent composition must be constantly agitated prior to and during use to prevent such phase separation.

Any suitable liquid hydrocarbon can be employed as the hydrocarbon solvent in the formulation of the acidic solvent compositions of the present invention. Typical liquid hydrocarbons which may be employed as the hydrocarbon solvent in the acidic solvent compositions are diesel fuel, kerosene, gasoline and naphta. However, especially desirable results have been obtained when kerosene is employed as the hydrocarbon solvent.

The hydrocarbon solvent of the acidic solvent compositions appears to possess two distinct functions, namely: (1) the hydrocarbon carrier mixes with the tar sand composition and thins the mass so that the individual grains of sand containing the bituminous coating can contact the acid portion of the acidic solvent composition; and (2) the friction reducing compound and the liquid hydrocarbon carrier form an upper phase upon standing which contains the recovered bituminous material so that substantially bituminous free grains of sand settle in the bottom of the mixing vessel due to gravity when agitation is ceased.

The acidic solvent compositions prepared as set forth above have been found to be effective solvents for the removal and recovery of bituminous materials from tar sands. Because of the unique properties of the acidic solvent compositions, vessels equipped with conventional stirrers and/or impellers can be employed in the removal and recovery of bituminous products from tar sands. In addition, it has unexpectedly been found that desirable results may be obtained when the agitation of the tar sand chunks and the acidic solvent is carried out by a stirrer or impeller rotating at from about 50 to about 350 r.p.m.; whereas when high speed agitation is employed sufficient contact of the acidic portion of the acidic solvent composition does not occur to allow for the substantial removal of the bituminous products from the tar sands. Further, because of the substantially inert, inactive properties of the resulting aqueous amine modified acidic compositions and the hydrofluoric acid until contacted with the tar sands, substantially no corrosion occurs in the treatment vessel due to the acidic components of the acidic solvent compositions, and health hazards generally experienced in the handling of strongly acidic compositions are not encountered.

In employing the acidic solvent compositions of the present invention for the removal and recovery of bituminous products from tar sands, the tar sands to be subjected to the acidic solvent composition are analyzed to determine the nature of the bituminous materials of the tar sands. This analysis is important because each tar sand deposit has individual characteristics. For example, certain tar sands contain bituminous products that are asphaltic in nature; whereas other tar sands contain bituminous products that are paraffinic in nature. Thus, the ingredients employed in the formulation of the acidic solvent composition can be varied within the ranges set forth hereinbefore so that the acidic solvent composition is formulated to enhance the removal and recovery of the bituminous products from the particular tar sand.

In addition, the temperature at which the acidic solvent composition is maintained during contact with the tar sand for the removal and recovery of the bituminous products can vary widely, and the temperature will generally depend to a large extend on the nature of the bituminous products. For example, when the bituminous material to be recovered is asphaltic in nature the contacting of the tar sand with the acidic solvent composition is carried out at ambient temperatures; whereas when the bituminous material to be recovered is paraffinic in nature the tar sand is preferably contacted with the acidic solvent composition which is heated and maintained at a temperature of from about 75° F. to about 175° F. so that the removed paraffinic hydrocarbons are maintained in a liquid state.

Any suitable vessel equipped with a stirrer or impeller capable of being rotated at a rate of from about 50 to about 350 r.p.m. can be employed to remove and recover bituminous products from tar sands in accordance with the present invention. For example, the vessel can be fabricated as a cylindrical sidewall having either an open or sealed top. A sand collector, having a funnel configuration, can extend downwardly from the lower periphery of the side wall such that the sand collector terminates at its lower end in an outlet. The vessel can also include an inlet chute for the chunks of tar sand, a liquid inlet, the stirrer or impeller, and if desired a product/liquid outlet. Vessels such as described above are conventional items. Thus, no further description of the vessel is believed necessary to enable one skilled in the art to understand the method for removing bituminous products from tar sands as described hereinafter.

In practicing the method for removal and recovery of bituminous products from tar sands in accordance with the present invention, an effective amount of the acidic solvent composition is charged to the vessel. Stirring of the acidic solvent composition is maintained in order to prevent separation of the acidic solvent composition into two phases as heretofore described. Once the acid solvent composition has been charged to the vessel, an effective amount of chunks of tar sand (desirably have a diameter of about 1 to 4 inches) are introduced into the vessel. The effective amounts of the acidic solvent composition and tar sands introduced into the vessel can vary widely, but will generally range from about 750 gallons to about 1500 gallons of acidic solvent composition per ton of tar sands. The amounts of the acidic solvent composition and tar sands introduced into the vessel will also depend to a large extent upon the capacity of the vessel. However, it is important that the amount of the acidic solvent composition be sufficient to substantially cover the chunks of tar sand in the vessel, both in the static and agitated state.

The agitation of the tar sand and acidic solvent composition is continued for an effective period of time to allow the acidic solvent composition to break down the matrix of the tar sand chunks and remove the bituminous products from the resulting granules. The effective period of time required for the acidic solvent composition to remove the bituminous products can vary widely, but will generally be from about 30 minutes to about 120 minutes, preferably from about 45 minutes to about 90 minutes.

After the tar sand and acidic solvent composition have been agitated for an effective period of time to enable the acidic solvent composition to remove substantially all of the bituminous products from the chunks of tar sand and/or resulting granules, the agitation is stopped. Upon stopping of the agitation of the acidic solvent composition and tar sand chunks and/or granules, the remaining tar sand chunks and/or granules settle to the bottom of the vessel by gravitational force, and the phase containing the friction reducing compound and the hydrocarbon solvent separates from the aqueous acidic composition and forms an upper layer containing the recovered bituminous material. The upper liquid phase containing separated bituminous products can thereafter be removed from the vessel and subjected to further processing using refining techniques well known in the art to recover the bituminous products; and the substantially bituminous free chunks or granules of sand can be removed from the vessel and discarded.

The remaining acidic composition can then be admixed with additional amounts of the friction reducing compound and the hydrocarbon solvent to form the acidic solvent composition. However, in each instance the recovered acidic composition should be analyzed to determine the proportions of each constituent remaining the the acidic composition. For example, when the acidic composition initially contains about 20 volume percent hydrofluoric acid, the acidic composition has been capable of being admixed with additional amounts of a friction reducing agent (such as oleic acid) and a hydrocarbon solvent (such as kerosene) and employed as an acidic solvent composition for six (6) additional batches of tar sands with the kerosene and the oleic acid being the only constituents needing replenishing after each batch run.

While the operation of the method for removing bituminous products from tar sands has been described as a batch process, it is to be understood that the method as described is equally applicable to a continuous process.

In order to more fully describe the present invention the following examples are set forth. It is to be understood that the examples are for illustrative purposes only and are not to be construed as limiting upon the scope of the invention as set forth in the appended claims.

EXAMPLE I

A. Preparation of the Aqueous Amine Modified Acidic Composition

A plurality of batches of an aqueous amine modified acidic composition was prepared using the following procedure.

71.38 pounds of hydrochloric acid and 41.50 pounds of phosphoric acid were added to a container and the acids were stirred to produce a substantially homogeneous acidic mixture. During the mixing of the hydrochloric acid and the phosphoric acid fumes were generated. Thus, the mixing of the hydrochloric acid and the phosphoric acid was carried out in a ventilated area.

332 pounds of clean water was then placed into a second container. 112.88 pounds of the hydrochloric-phosphoric acid mixture was added to the water in the second container. The resulting aqueous acidic solution was mixed thoroughly. Thereafter, 21.58 pounds of powdered citric acid and 14.94 pounds of powered oxalic acid were admixed into the aqueous acidic mixture to produce an aqueous acidic composition.

The aqueous acidic composition was then diluted by admixing 481.40 pounds of the aqueous acidic composition with 332 pounds of clean water in a third container. The aqueous acidic composition and water were thoroughly stirred and provided 97 gallons (814 pounds) of the aqueous acidic composition having a pH value of about 0.49.

Following the dilution of the aqueous acidic composition described above, 16.6 pounds of hexamethylenetetramine was admixed into 814 pounds of the aqueous acidic composition and mixing continued until a substantially homogeneous colorless liquid was formed. An aqueous amine modified acidic composition (having a volume of 100 gallons and a total weight of 830 pounds) had a pH value of about 0.91. It should be noted that the mixing and storage containers employed in the preparation of the aqueous amine modified acidic composition were fiberglass containers, and each of the containers were covered for safety reasons and to prevent foreign materials from being introduced into the product.

B. Preparation of the Acidic Solvent Composition

A plurality of batches of the acidic solvent composition useful in the removal of bituminous products from tar sands in accordance with the present invention were prepared as follows:

757 milliliters of the aqueous amine modified acidic composition prepared in accordance with the procedure set forth in Example I.A. were placed in a one (1) gallon vessel equipped with a stirring mechanism. The aqueous amine modified acidic composition was stirred while 379 milliliters of hydrofluoric acid were introduced into the aqueous amine modified acidic composition. Stirring was continued until a substantially homogeneous resulting acidic mixture was formed. Thereafter 379 milliliters of oleic acid and 2271 milliliters of kerosene were sequentially admixed into the resulting acidic mixture under constant stirring conditions. The acidic solvent composition so formed contained about 20 volume percent of the aqueous amine modified acidic composition, about 10 volume percent hydrofluoric acid, about 10 volume percent oleic acid, and about 60 volume percent kerosene. The resulting acidic solvent composition appeared to be a substantially homogeneous dispersion as long as stirring was continued. However, when stirring was stopped the oleic acid and kerosene readily separated from the aqueous amine modified acidic composition as an upper layer or phase.

EXAMPLE II

A series of experiments were conducted on a plurality of samples of tar sands obtained from various deposits throughout the United States. In each experiment one gallon (approximately 3786 milliliters) of the acidic solvent composition prepared in accordance with the procedures set forth in Example I.B. was charged to a vessel equipped with a stirrer rotating at 150 r.p.m. The acidic solvent composition was stirred to prevent the oleic acid and kerosene from separating from the aqueous amine modified acid composition. One kilogram of tar sand was then added to each of the containers and stirring was continued for 60 minutes. The tar sand was in the form of chunks having an average diameter of from about 1 to about 2 inches. At the end of the sixty minute period stirring was stopped. Granules of sand settled to the bottom of the vessel, the oleic acid and kerosene separated as an upper phase, and the displaced bituminous products were present in the upper phase of the oleic acid and kerosene. The volume percent of bituminous product recovered from the tar sand samples was determined based upon the estimated volume of bituminous products originally present in the tar sand samples.

The data from such experiments are set forth in the Table hereinbelow. For ease of comparison the estimated gallons of bituminous products contained in the various samples of tar sand, and the recovered gallons of bituminous product after treatment of the samples of tar sand in accordance with the present invention, each have been extrapolated to gallons of bituminous material per ton of tar sand.

TABLE

| Tar Sand Sample Deposit Identity | Estimated Gallons of Bituminous Product Per Ton of Tar Sand | Recovered Gallons of Bituminous Product Per Ton of Tar Sand | Volume Percent (%) Bituminous Product Recovered | Contact Time (Minutes) at Ambient Temperatures and 150 r.p.m. |
|---|---|---|---|---|
| Vernal, Utah | 17.0 | 14.8 | 87 | 60 |
| Sunnyside, Utah | 17.5 | 15.6 | 89 | 60 |
| P.R. Springs, Utah | 16.0 | 14.7 | 92 | 60 |
| Davis, Oklahoma | 22.0 | 21.1 | 96 | 60 |
| Tar-Sand Triangle | 17.5 | 15.9 | 91 | 60 |
| Asphalt Ridge | 14.7 | 13.5 | 92 | 60 |

The granules of sand removed from the bottom of the vessel after completion of the experiments were whitish in color. This was an indication that a substantial amount of the bituminous products had been removed from the tar sands. Further, it is believed that by increasing the contact time between the tar sand and the acidic solvent composition the residual amounts of the bituminous materials present on the granules of sand could be effectively removed and recovered.

Example II clearly indicates the recovery of bituminous products from tar sand using the acidic solvent composition as prepared in Examples I.A. and I.B. Thus, it is clear that the present invention is well adapted to carry out the objects and attain the ends and advantages mentioned herein as well as those inherent in the invention. While presently preferred embodiments of the invention have been described for purposes of this disclosure, numerous changes may be made which will readily suggest themselves to those skilled in the art and which are accomplished within the spirit of the invention disclosed and as defined in the appended claims.

What is claimed is:

1. An improved acidic solvent composition for separation of bituminous products from tar sands, said acidic solvent composition comprising from about 15 to about 30 volume percent of an aqueous amine modified acidic constituent having a pH value of less than about 1, from about 1 to about 20 volume percent hydrofluoric acid, from about 4 to about 20 volume percent of a friction reducing compound and from about 30 to about 80 volume percent of a hydrocarbon solvent, the aqueous amine modified acidic constituent being prepared by the steps of:

mixing from about 45 to about 80 weight percent hydrochloric acid with from about 20 to about 55 weight percent phosphoric acid to produce a substantially homogeneous acidic mixture;

admixing the acidic mixture with an effective amount of water to provide an aqueous acidic mixture;

admixing from about 2 to about 20 weight percent of a hydroxy carboxylic acid and from about 0 to about 20 weight percent of a dicarboxylic acid into the aqueous acidic mixture to produce a hydroxy carboxylic acid containing aqueous acidic mixture; and admixing a minor effective amount of a polyamine with the hydroxy carboxylic acid containing aqueous acidic mixture to produce the aqueous amine modified acidic constituent.

2. The improved acidic solvent composition of claim 1 wherein the friction reducing compound is an organic acid selected from the group consisting of acetic acid, lauric acid and oleic acid.

3. The improved acidic solvent composition of claim 2 wherein the friction reducing compound is oleic acid.

4. The improved acidic solvent composition of claim 1 wherein the hydrocarbon solvent is selected from the group consisting of diesel fuel, kerosene, gasoline and naphta.

5. The improved acidic solvent composition of claim 4 wherein the hydrocarbon solvent is kerosene.

6. The improved acidic solvent composition of claim 1 wherein the effective amount of water admixed with the acidic mixture to provide the aqueous acidic mixture in the preparation of the aqueous amine modified acidic constituent is an amount sufficient to provide the aqueous acidic mixture with from about 70 to about 90 percent water.

7. The improved acidic solvent composition of claim 6 wherein the preparation of the aqueous amine modified acidic composition further comprises the step of:

admixing up to about 20 weight percent of a dicarboxylic acid into the hydroxy carboxylic acid containing mixture prior to the addition of the polyamine.

8. The improved acidic solvent composition of claim 7 wherein the aqueous amine modified acidic composition is further characterized as containing from about 70 to about 90 weight percent water.

9. The improved acidic solvent composition of claim 8 wherein the hydroxy carboxylic acid employed in the preparation of the aqueous amine modified acidic constituent is present in an amount of from about 2 to about 10 weight percent.

10. The improved acidic solvent composition of claim 9 wherein the hydroxy carboxylic acid is citric acid.

11. The improved acidic solvent composition of claim 10 wherein the dicarboxylic acid employed in the preparation of the aqueous amine modified acidic constituent is present in an amount of from about 1 to about 10 weight percent.

12. The improved acidic solvent composition of claim 11 wherein the dicarboxylic acid is oxalic acid.

13. The improved acidic solvent composition of claim 6 wherein the minor effective amount of the polyamine incorporated into the hydroxy carboxylic acid containing aqueous acidic mixture during the preparation of the aqueous amine modified acidic constituent is from about 1 to about 5 weight percent.

14. The improved acidic solvent composition of claim 13 wherein the polyamine is hexamethylenetetramine.

15. The improved acidic solvent composition of claim 13 wherein the polyamine employed in the preparation of the aqueous amine modified acidic constituent is hexamethylenetetramine, and the hexamethylenetetramine is incorporated into the hydroxy carboxylic acid containing aqueous acidic mixture in an amount of from about 2 to about 3 weight percent.

16. The improved acidic solvent composition of claim 15 wherein the hydrocarbon solvent is selected from the group consisting of diesel fuel, kerosene, gasoline and naphtha.

17. The improved acidic solvent composition of claim 16 wherein the friction reducing compound is an organic acid selected from the group consisting of acetic acid, lauric acid and oleic acid.

18. The improved acidic solvent composition of claim 17 wherein the aqueous amine modified constituent is present in an amount of about 20 volume percent, the hydrofluoric acid is present in an amount of about 10 volume percent, the friction reducing compound is oleic acid and is present in an amount of about 10 volume percent, and the hydrocarbon solvent is kerosene and is present in an amount of about 60 volume percent.

19. A method for separating bituminous products from tar sands comprising the steps of:

(a) charging a predetermined amount of an acidic solvent composition into a vessel, the acidic solvent consisting essentially of from about 15 to about 30 volume percent of an aqueous amine modified acidic constituent having a pH value of less than about 1, from about 1 to about 20 volume percent hydrofluoric acid, from about 4 to about 20 volume percent of a friction reducing compound, and from about 30 to about 80 volume percent of a hydrocarbon solvent, said aqueous amine modified acidic constituent prepared by the steps of:

(i) mixing from about 45 to about 80 weight percent hydrochloric acid with from about 20 to about 55 weight percent phosphoric acid to produce a substantially homogeneous acidic mixture;

(ii) admixing the acidic mixture with an effective amount of water to provide an aqueous acidic mixture;

(iii) admixing from about 2 to about 20 weight percent of a hydroxy carboxylic acid and from about 0 to about 20 weight percent of a dicarboxylic acid into the aqueous acidic mixture to produce a hydroxy carboxylic acid containing aqueous acidic mixture; and (iv) admixing a minor effective amount of a polyamine with the hydroxy carboxylic acid containing aqueous acidic mixture to produce the aqueous amine modified acidic constituent.

(b) agitating the acidic solvent composition to form a substantially uniform dispersion between the acid components, the friction reducing compound and the hydrocarbon solvent;

(c) charging a predetermined amount of chunks of tar sand into the vessel, the predetermined amount of chunks of tar sand enabling the acidic solvent composition to substantially cover and suspend the chunks of tar sand as the acidic solvent composition and chunks of tar sand are brought into contact via agitation; and (d) maintaining agitation on the acidic solvent composition and the chunks of tar sand in the vessel for an effective period of time to enable the acidic solvent composition to remove the bituminous products from the sand particles of the tar sand.

20. The method for separating bituminous products from tar sands of claim 19 wherein the agitating of the acidic solvent composition and chunks of tar sand in the vessel is achieved by a stirrer operating at a rate of from about 50 to about 350 r.p.m.

21. The method for separating bituminous products from tar sands of claim 20 wherein the acidic solvent composition is maintained at a temperature of from about ambient temperatures to about 175° F. during contact with the chunks of tar sand.

22. The method for separating bituminous products from tar sands of claim 21 wherein the chunks of tar sand are characterized as having an average diameter of from about 1 to about 4 inches.

23. The method for separating bituminous products from tar sands of claim 20 wherein the effective period of time in which the acidic solvent composition and the chunks of tar sand are agitated in the vessel is from about 30 minutes to about 120 minutes.

24. The method for separating bituminous products from tar sands of claim 20 wherein the predetermined amount of the acidic solvent composition charged to the vessel is an amount sufficient to provide from about 750 gallons to about 1500 gallons of the acidic solvent composition per ton of tar sand charged to the vessel.

25. The method for separating bituminous products from tar sands of claim 19 wherein the effective amount of water admixed with the acidic mixture to provide the aqueous acidic mixture in the preparation of the aqueous amine modified acidic constituent is an amount sufficient to provide the aqueous acidic mixture with from about 70 to about 90 percent water.

26. The method for separating bituminous products from sands of claim 25 wherein the preparation of the aqueous amine modified acidic composition further comprises the step of:

admixing up to about 20 weight percent of a dicarboxylic acid into the hydroxy carboxylic acid containing mixture prior to the addition of the polyamine.

27. The method for separating bituminous products from tar sands of claim 26 wherein the aqueous amine modified acidic composition is further characterized as containing from about 70 to about 90 weight percent water.

28. The method for separating bituminous products from tar sands of claim 27 wherein the hydroxy carboxylic acid employed in the preparation of the aqueous amine modified acidic constituent is present in an amount of from about 2 to about 10 weight percent.

29. The method for separating bituminous products from tar sands of claim 28 wherein the hydroxy carboxylic acid is citric acid.

30. The method for separating bituminous products from tar sands of claim 29 wherein the dicarboxylic acid employed in the preparation of the aqueous amine modified acidic constituent is present in an amount of from about 1 to about 10 weight percent.

31. The method for separating bituminous products from tar sands of claim 30 wherein the dicarboxylic acid is oxalic acid.

32. The method for separating bituminous products from tar sands of claim 19 wherein the minor effective amount of the polyamine incorporated into the hydroxy carboxylic acid containing aqueous acidic mixture during the preparation of the aqueous amine modified constituent is from about 1 to about 5 weight percent.

33. The method for separating bituminous products from tar sands of claim 32 wherein the polyamine is hexamethylenetetramine.

34. The method for separating bituminous products from tar sands of claim 32 wherein the polyamine employed in the preparation of the aqueous amine modified constituent is hexamethylenetetramine, and the hexamethylenetetramine is incorporated into the hydroxy carboxylic acid containing aqueous acidic mixture in an amount of from about 2 to about 3 weight percent.

35. The method for separating bituminous products from tar sands of claim 19 wherein the friction reducing compound of the acidic solvent composition is an organic acid selected from the group consisting of acetic acid, lauric acid and oleic acid.

36. The method for separating bituminous products from tar sands of claim 35 wherein the hydrocarbon solvent of the acidic solvent composition is selected from the group consisting of diesel fuel, kerosene, gasoline and naptha.

37. The method for separating bituminous products from tar sands of claim 36 wherein the friction reducing compound is oleic acid, the hydrocarbon solvent is kerosene, and wherein the acidic solvent composition contains about 20 volume percent of the aqueous amine modified acidic constituent, about 10 volume percent hydrofluoric acid, about 10 volume percent oleic acid, and about 60 volume percent kerosene.

38. The method for separating bituminous products from tar sands of claim 19 wherein the hydrocarbon solvent of the acidic solvent composition is diesel fuel, kerosene, gasoline and naptha.

39. The method for separating bituminous products of claim 19 further comprising:

ceasing agitation of the acidic solvent composition so as to allow the friction reducing compound and the hydrocarbon solvent to separate from the aqueous amine modified acidic constituent and the hydrofluoric acid and form an upper phase containing separated bituminous products; and separating the upper phase containing the bituminous products from the aqueous solution containing the acidic components and substantially bituminous free granules.

* * * * *